United States Patent [19]

Beamon

[11] 4,283,756

[45] Aug. 11, 1981

[54] FLASHING-LIGHT BELT

[76] Inventor: Turan M. Beamon, 2722 E. 77th St., Chicago, Ill. 60649

[21] Appl. No.: 48,709

[22] Filed: Jun. 15, 1979

[51] Int. Cl.[3] ..... F21L 15/14

[52] U.S. Cl. ..... 362/108; 362/252; 362/806

[58] Field of Search ..... 362/103, 108, 252, 806

[56] References Cited

U.S. PATENT DOCUMENTS

| | | | |
|---|---|---|---|
| 2,378,075 | 6/1945 | Frecska | 362/108 |
| 3,641,333 | 2/1972 | Gendron | 362/108 |
| 3,840,853 | 10/1974 | Cukale | 362/108 |
| 4,112,482 | 9/1979 | Powell | 362/108 |

*Primary Examiner*—Stephen J. Lechert, Jr.

*Attorney, Agent, or Firm*—Vogel, Dithmar, Stotland, Stratman & Levy

[57] ABSTRACT

The belt includes the usual flexible strip and buckle. Flashing-light means is mounted in the buckle and is powered by a portable supply which may be located in the wearer's pocket. Preferably the light means takes the form of two associated flasher circuits.

7 Claims, 4 Drawing Figures

FIG. 1
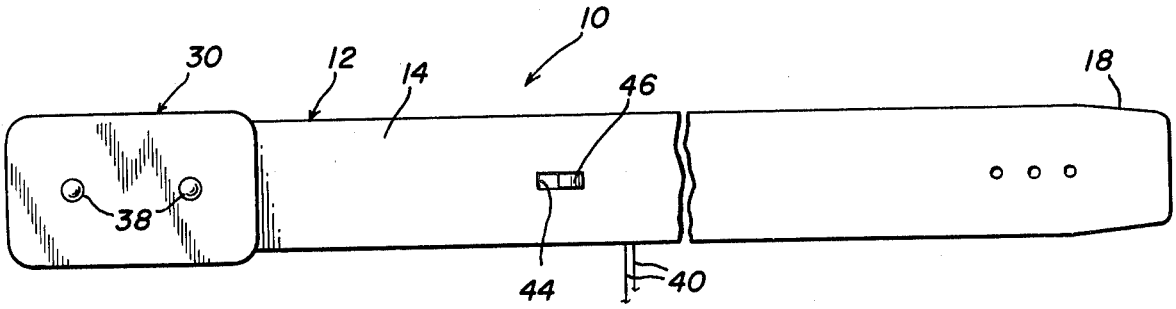
FIG. 2
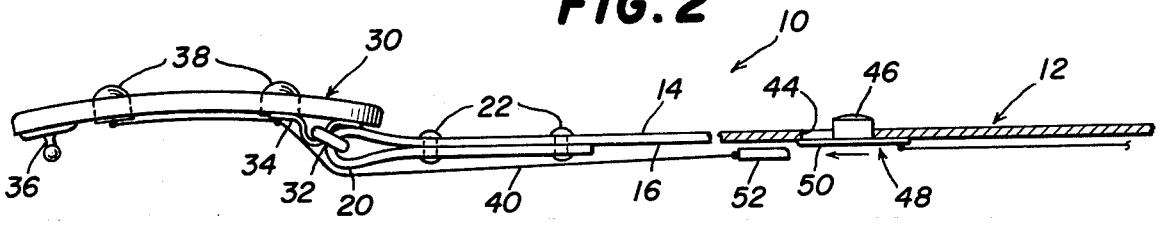
FIG. 3
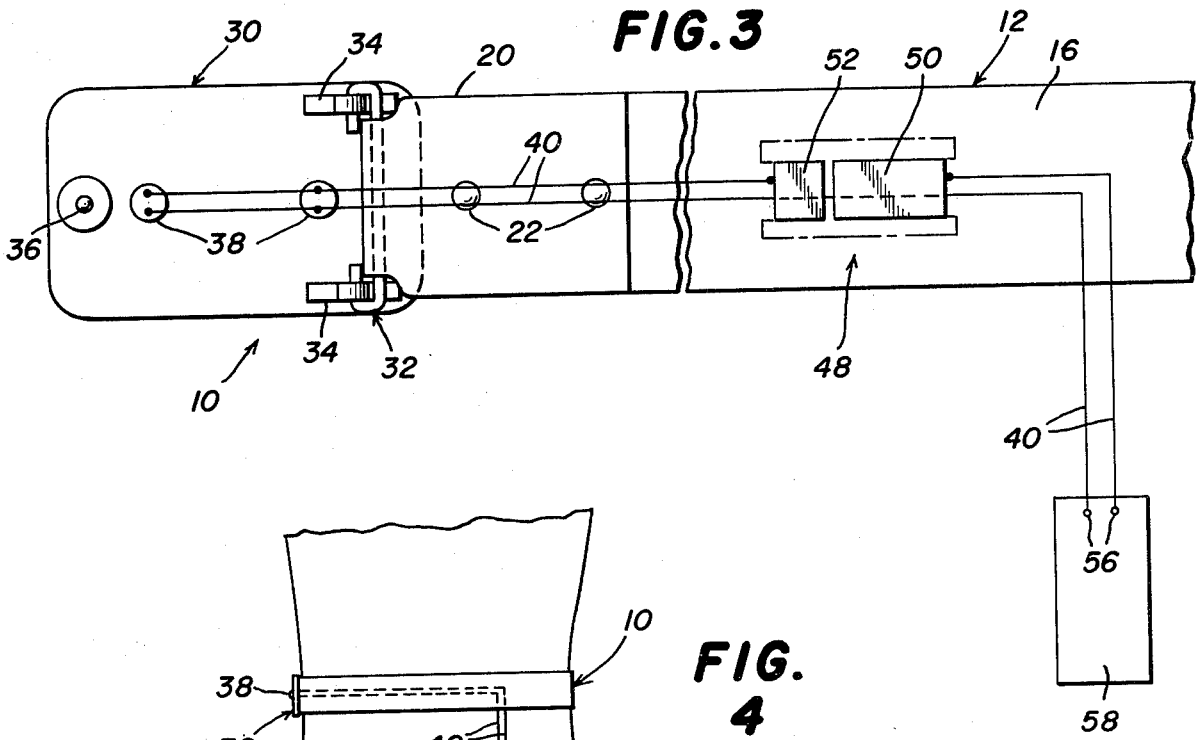
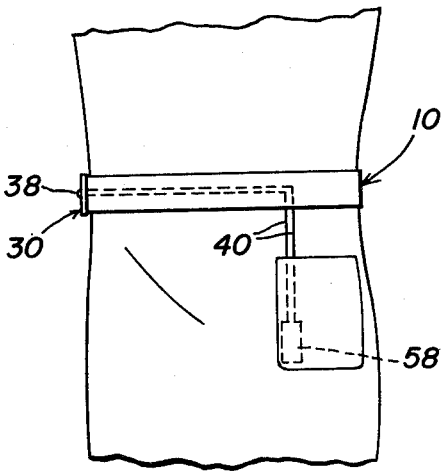
FIG. 4

FLASHING-LIGHT BELT

SUMMARY OF THE INVENTION

It is an important object of the present invention to provide a belt in which flashing-light means are provided in the buckle.

In summary, there is provided a belt comprising a flat flexible strip for encircling one's torso and having an inside surface and an outside surface and two ends, a buckle on one end of the strip for removable attachment to a point on the strip adjacent the other end thereof, light means in the buckle having at least one bulb and circuit means for flashing the bulb when energized, conductor means on the inside surface of the strip and being electrically attached to the light means, switch means electrically connected to the conductor means for selectively opening and closing the current path defined thereby, and terminal means on the conductor means for attachment to a portable souce of electrical power.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the invention.

BRIEF DESCRIPTION OF THE DRAWINGS

For the purpose of facilitating an understanding of the invention, there is illustrated in the accompanying drawings, a preferred embodiment thereof, from an inspection of which, when considered in connection with the following description, the invention, its construction, and operation, and many of its advantages should be readily understood and appreciated.

FIG. 1 is a plan view of a belt incorporating the features of the present invention;

FIG. 2 is a sie elevational view of the belt of FIG. 1;

FIG. 3 is a plan view of the inside of a part of the belt; and

FIG. 4 depicts the manner in which the belt is worn by a user.

DESCRIPTION OF THE PREFERRED EMBODIMENT

Referring now to the drawings, and more particularly to FIGS. 1 and 2 thereof, there is shown a belt 10 including a flexible strip 12 with an outside surface 14, an inside surface 16, an end 18, and an end portion 20. The end portion 20 has rivets 22 to create a loop in which a belt buckle 30 is mounted. The belt buckle includes a C-shaped clip 32 having its main leg passing through the eye of the end portion 20 and having its shorter legs passing through attachment clips 34 on the inside surface of the buckle 30. On the free end of the buckle 30 is a finger 36 adapted to be inserted in one of the holes in the end 18. The enlarged end of the finger 36 inhibits retrograde motion to improve the interconnection between the buckle 30 and the strip 12.

Mounted in the buckle 30 are a pair of light means 38, each of which includes an LED and an oscillator circuit mounted in a common package. For example, lamp means sold by Archer Electronics under its number FRL 4403 can be used. The terminals of the two light means 38 are connected together and to a pair of conductors 40 which extends along and is secured to the inside surface 16 of the flexible strip 12. Alternatively, the conductors would pass through the inside of the strip 12. The flexible strip 12 has a slot 44 therein through which passes the actuator 46 of a switch 48. The actuator 46 is connected to a movable element 50, there also being a stationary element 52. One of the conductors 40 is broken and its ends are connected to the elements 50 and 52, respectively, while the other one of the conductors 40 passes between the switch 48 and the inside surface 16.

The conductors 40 extend about a quarter way around the flexible strip 12 and then extend downwardly. Terminal means 56 on the end of the conductors 40 are connected to a portable power supply 58 which may be a pair of batteries connected in series and held in a case. The supply 58 is adapted, for example, to be placed in the user's back pocket as shown in FIG. 4.

When the switch is open, as shown in FIGS. 1–3, the light means 38 is not operative. When the wearer desires to turn the light means 38 on, he operates the actuator 46 which is readily accessible to him. Thus, power from the supply 58 is delivered to the light means 38 causing the LEDs to flash at a predetermined rate.

What has been described therefore is an improved belt having flashing light means in the buckle.

I claim:

1. A belt comprising a flat flexible strip for encircling one's torso, and having an inside surface and an outside surface and two ends, a buckle on one end of said strip for removable attachment to a point on said strip adjacent the other end thereof, light means in said buckle having at least two bulbs and circuit means for flashing said bulb when energized, each of said bulbs and said circuit means being cased in a single package, conductor means on the inside surface of said strip and being electrically attached to said light means, switch means electrically connected to said conductor means for selectively opening and closing the current path defined thereby, and terminal means on said conductor means for attachment to a portable source of electrical power.

2. The belt of claim 1, wherein said buckle has at least one opening therein for accommodating said light means.

3. The belt of claim 1, wherein each of said bulbs is a light-emitting diode.

4. The belt of claim 1, wherein said conductor means consists of a pair of conductors attached to the inside surface of said flexible strip.

5. The belt of claim 1, wherein said switch means includes an actuator readily accessible to the wearer.

6. The belt of claim 1, wherein said flexible loop has a slot therein, and said switch means has an actuator protruding through said slot to be accessible on the outside surface of said flexible strip.

7. The belt of claim 1, wherein said conductor means extends about one-quarter of the leng h of said flexible strip and then depends therefrom, so as to extend into the wearer's pocket, in which is located the portable source of electrical power connected to said conductor means.

* * * * *